US007471267B2

(12) United States Patent
Shin et al.

(10) Patent No.: US 7,471,267 B2
(45) Date of Patent: Dec. 30, 2008

(54) DISPLAY PANEL, LIGHT EMITTING DISPLAY USING THE DISPLAY PANEL, AND DRIVING METHOD THEREOF

(75) Inventors: Dong-Yong Shin, Seoul (KR); Yojiro Matsueda, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 655 days.

(21) Appl. No.: 10/886,324

(22) Filed: Jul. 7, 2004

(65) Prior Publication Data

US 2005/0007319 A1 Jan. 13, 2005

(30) Foreign Application Priority Data

Jul. 8, 2003 (KR) ..... 10-2003-0046163

(51) Int. Cl.
*G09G 3/30* (2006.01)
*G09G 3/10* (2006.01)

(52) U.S. Cl. ..... 345/76; 345/690; 315/169.3

(58) Field of Classification Search ... 315/169.1–169.4; 345/76–83, 390, 211
See application file for complete search history.

(56) References Cited

U.S. PATENT DOCUMENTS 6,661,180 B2 * 12/2003 Koyama ..... 315/169.3
6,909,242 B2 * 6/2005 Kimura ..... 315/169.3
7,138,967 B2 * 11/2006 Kimura ..... 345/76
2002/0135312 A1 9/2002 Koyama
2003/0218584 A1 * 11/2003 Kimura ..... 345/76
2005/0180083 A1 8/2005 Takahara et al.

FOREIGN PATENT DOCUMENTS

JP 2003-122306 4/2003
JP 2003-150109 5/2003
JP 2004-500275 10/2004
WO WO 03/091977 A1 11/2003

OTHER PUBLICATIONS

Patent Abstracts of Japan, Publication No. 2003-122306, dated Apr. 25, 2003, in the name of Yumoto Akira.
Patent Abstracts of Japan, Publication No. 2003-150109, dated May 23, 2003, in the name of Hiroshi Takahara.

* cited by examiner

*Primary Examiner*—Duc Q Dinh
(74) *Attorney, Agent, or Firm*—Christie, Parker & Hale, LLP

(57) ABSTRACT

An emission display includes data lines, select signal lines, emit signal lines, and pixel circuits including switches, a transistor, and an emission element. The first switch transmits a data current from the data line in response to a first scan signal from the select signal line, and the capacitor charges a voltage corresponding to the data current from the first switch. The second switch supplies the current from the transistor to the emission element in response to a second scan signal having a first level from the emit signal line during a display period. During a non-display period, the second switch is turned off in response to the second scan signal having a second level, and no current from the transistor is supplied to the emission element.

18 Claims, 6 Drawing Sheets

DISPLAY PANEL, LIGHT EMITTING DISPLAY USING THE DISPLAY PANEL, AND DRIVING METHOD THEREOF

CROSS REFERENCE TO RELATED APPLICATION

This application claims priority to and the benefit of Korean Patent Application No. 2003-46163 filed on Jul. 8, 2003 in the Korean Intellectual Property Office, the entire content of which is incorporated herein by reference.

BACKGROUND OF THE INVENTION (a) Field of the Invention

The present invention relates to a display panel, a light emitting display using the display panel, and a driving method thereof. More specifically, the present invention relates to an organic electroluminescent (EL) display panel, a light emitting display using the EL display panel, and a driving method thereof.

(b) Description of the Related Art

In general, an organic EL display panel is a display device for electrically exciting fluorescent and organic compounds and emitting light. In such an organic EL display panel, (M×N) organic emission cells are voltage or current driven to represent images. An organic emission cell includes an anode (typically formed using indium tin oxide (ITO)), an organic thin film, and a metallic cathode layer. The organic thin film includes an emission layer (EML), an electron transport layer (ETL), and a hole transport layer (HTL) for balancing electrons and holes to improve emission efficacy. The organic thin film also includes an electron injection layer (EIL) and a hole injection layer (HIL).

Methods for driving the organic emission cells include a passive matrix method, and an active matrix method using thin film transistors (TFTs). The passive matrix method uses anodes and cathodes that cross each other. In the passive matrix method, a line is selected to drive the organic emission cells. The active matrix method uses TFTs that access respective ITO pixel electrodes. In the active matrix method, a line is driven according to a voltage maintained by the capacitance of a capacitor coupled to a gate of a TFT. The active matrix method is categorized, depending on formats of signals applied to the capacitor for establishing the voltage, as a voltage programming method or a current programming method.

FIG. 1 shows an equivalent circuit diagram for a pixel circuit that implements the conventional voltage programming method. As shown in the equivalent circuit diagram of FIG. 1, a transistor M1 is coupled to an organic EL element (OLED) to supply the current for emission, and the current of the transistor M1 is controlled by a data voltage applied through a switching transistor M2. A capacitor C1 for maintaining the applied voltage for a predetermined time is coupled between a source and a gate of the transistor M1.

When the switching transistor M2 is turned on, the data voltage is applied to the gate of the transistor M1 to charge the capacitor C1 with the voltage $V_{GS}$ between the gate and the source, a current $I_{OLED}$ flows though the transistor M1 in response to the voltage $V_{GS}$, and the OLED emits light in response to the current $I_{OLED}$.

The current flowing through the OLED is given as Equation 1.

$$I_{OLED} = \frac{\beta}{2}(V_{GS} - V_{TH})^2 = \frac{\beta}{2}(V_{DD} - V_{DATA} - |V_{TH}|)^2 \quad \text{Equation 1}$$

where $I_{OLED}$ is a current flowing through the OLED, $V_{GS}$ is a voltage between the gate and the source of the transistor M1, $V_{TH}$ is a threshold voltage of the transistor M1, $V_{DATA}$ is a data voltage, and β is a constant.

As given in Equation 1, the current corresponding to the data voltage is supplied to the OLED, and the OLED emits light in response to the supplied current. The applied data voltage has multiple-stage values within a predetermined range so as to represent gray scales.

The pixel circuit for implementing the conventional voltage programming method has difficulties in obtaining high gray scales because of variations in the threshold voltage $V_{TH}$ and the carrier mobility. Such variations are caused by non-uniformity of a manufacturing process. For example, in order to represent 8-bit (i.e., 256) gray scales by driving TFTs using the voltage of 3 volts (3V), the voltage applied to the gate of the TFT should have an interval of less than the voltage of approximately 12 mV(=3V/256). Hence, if the variation in the threshold voltage of the TFT caused by the non-uniformity of the manufacturing process is 100 mV, it is difficult to represent high gray scales. Also, representing high gray scales is further complicated since the value of β in Equation 1 is not constant because of the variation of electron mobility.

The pixel circuit of the current programming method achieves substantially uniform display characteristics when the driving transistor in each pixel has substantially nonuniform voltage-current characteristics, provided that a current source for supplying the current to the pixel circuit is substantially uniform throughout the whole panel.

FIG. 2 shows an equivalent circuit of a pixel circuit for implementing a conventional current programming method. As shown, the transistor M3 is coupled to an OLED to supply the current for emission, and the current of the transistor M3 is controlled by a data current applied through a transistor M4.

Accordingly, when transistors M4 and M5 are turned on, the voltage corresponding to the data current $I_{DATA}$ is stored in a capacitor C2 coupled between the source and the gate of the transistor M3, and a current corresponding to the voltage stored in the capacitor C2 flows to and through the OLED to emit light. The current flowing through the OLED is given as Equation 2.

$$I_{OLED} = \frac{\beta}{2}(V_{GS} - V_{TH})^2 = I_{DATA} \quad \text{Equation 2}$$

where $V_{GS}$ is a voltage between the gate and the source of the transistor M3, $V_{TH}$ is a threshold voltage of the transistor M3, and β is a constant.

As given, since the current $I_{OLED}$ flowing through the OLED is proportional to the data current $I_{DATA}$ in the equivalent circuit of FIG. 2, substantially uniform characteristics are obtained provided that the programming current source is substantially uniform throughout the whole panel. However, the current $I_{OLED}$ flowing through the OLED has a small magnitude, and requires a relatively long time to charge a data line with the current $I_{DATA}$, which also has a small magnitude.

For example, several milliseconds are typically required to charge the load of the data line with the data current of about several tens to several hundreds of nano amps (nA), assuming that the capacitance of the data line is 30 pF. As the line time is only several tens of μs, the charging time is too long.

Also, when the current $I_{OLED}$ flowing though the OLED is increased so as to reduce the time used for charging the data line, the total brightness of pixels increases and image characteristics worsen.

SUMMARY OF THE INVENTION

Exemplary embodiments of the present invention provide for preventing worsening of image characteristics, and quickly charging the data line.

Exemplary embodiments of the present invention also provide for improving the quality of the emission display.

In the exemplary embodiments of the present invention, the emission display is driven by a pulse method (i.e., a duty driving method). Further, the emission display may be driven in the interlacing manner.

In an exemplary embodiment of the present invention, an emission display includes: a plurality of data lines formed in one direction, each data line for transmitting a data current, and a plurality of select signal lines and emit signal lines crossing the data lines for transmitting first and second scan signals, respectively. The emission display also includes a display panel including a first switch formed on a pixel area defined by a corresponding data line, a corresponding select signal line, and a corresponding emit signal line, for transmitting the data current from the corresponding data line in response to the first scan signal from the corresponding select signal line. A pixel circuit includes a capacitor for charging a voltage corresponding to the data current from the first switch, an emission element, a transistor for supplying a current corresponding to the voltage charged in the capacitor to the emission element, and a second switch for supplying the current from the transistor to the emission element in response to a first level of the second scan signal from the corresponding emit signal line. A driver supplies the first scan signal to the corresponding select signal line, and supplies the second scan signal to the corresponding emit signal line. The select signal lines include first select signal lines and second select signal lines, wherein the corresponding select signal line is one of the first select signal lines. The driver supplies the second scan signal having the first level to the corresponding emit signal line during a predetermined time period in a single frame, transmits the first scan signal to the corresponding select signal line during a first field of the single frame, and transmits the first scan signal to one of the second select signal lines during a second field of the single frame.

In another exemplary embodiment of the present invention, the emit signal lines include first emit signal lines and second emit signal lines, wherein the corresponding emit signal line is one of the first emit signal lines. The driver transmits the second scan signal to the corresponding emit signal line in the first field of the single frame, and transmits the second scan signal to one of the second emit signal lines in the second field of the single frame.

The driver may include: a first scan driver for supplying the first scan signal to each of the first select signal lines during the first field; a first brightness control driver for supplying the second scan signal to each of the first emit signal lines during the first field; a second scan driver for supplying the first scan signal to each of the second select signal lines during the second field; and a second brightness control driver for supplying the second scan signal to each of the second emit signal lines during the second field. At least one of the drivers may also include a shift register.

In yet another exemplary embodiment of the present invention, the second scan signal is a pulse, which is switched between the first level and a second level, the emission element emits light responsive to the current from the second switch when the second scan signal has the first level, and the current supplied to the emission element is interrupted when the second scan signal has the second level. The second scan signal may be a pulse, which is switched between the first and second levels in a single field.

In still another exemplary embodiment of the present invention, the display panel further includes a third switch for charging the voltage corresponding to the data current from the corresponding data line in the capacitor in response to the first scan signal. The capacitor may charge the voltage corresponding to the data current when the second scan signal has a second level.

In a further exemplary embodiment of the present invention, the first select signal lines and the first emit signal lines are odd select signal lines and odd emit signal lines, respectively, and the second select signal lines and the second emit signal lines are even select signal lines and even emit signal lines, respectively.

In a still further exemplary embodiment of the present invention, the first select signal lines and the first emit signal lines are even select signal lines and even emit signal lines, respectively, and the second select signal lines and the second emit signal lines are odd select signal lines and odd emit signal lines, respectively.

In yet another exemplary embodiment of the present invention, a display panel includes: a plurality of data lines formed in one direction, each data line for transmitting a data current; a plurality of select signal lines and emit signal lines crossing the data lines, for transmitting first and second scan signals, respectively; a pixel circuit including a first switch formed on a pixel area defined by a corresponding data line, a corresponding select signal line, and a corresponding emit signal line, for transmitting the data current from the corresponding data line in response to the first scan signal from the corresponding select signal line; a capacitor for charging a voltage corresponding to the data current from the first switch; an emission element; a transistor for supplying a current corresponding to the voltage charged in the capacitor to the emission element; and a second switch for supplying the current from the transistor to the emission element in response to a first level of the second scan signal from the corresponding emit signal line. The select signal lines include first and second select signal lines, and the emit signal lines include first and second emit signal lines. The first and second scan signals are transmitted to the first select signal line and the first emit signal line, respectively, during an odd field of a single frame and the first and second scan signals are transmitted to the second select signal line and the second emit signal line, respectively, during an even field of the single frame. The second scan signal has the first level during a predetermined time period in a single frame.

The second scan signal may be a pulse, which is switched between the first and second levels, and the emission element emits light responsive to the current from the second switch when the second scan signal is of the first level, and the current supplied to the emission element is interrupted when the second scan signal has the second level.

In still another exemplary embodiment of the present invention, a method is provided for driving an emission display including a data line, a first select signal line, a second select signal line, a first emit signal line, a second emit signal line, a pixel circuit formed at a pixel area defined the data line, the first select signal line, and the first emit signal line, and a second pixel circuit formed at a second pixel area defined by the data line, the second select signal line and the second emit signal line, wherein the select signal lines and the emit signal lines cross the data line. The pixel circuit and the second pixel circuit each include a capacitor, a transistor for supplying a current corresponding to a voltage charged in the capacitor, and an emission element. The method includes: (a) charging the voltage corresponding to a data current from the data line in the capacitor of the pixel circuit in response to a first scan signal applied through the first select signal line, while a second scan signal applied through the first emit signal line has a first level during a first field of a single frame; (b) emitting light using the emission element of the pixel circuit in response to the current corresponding to the voltage charged in the capacitor of the pixel circuit transmitted from the transistor of the pixel circuit in response to a the second scan signal having a second level, applied through the first emit signal line; (c) charging a second voltage corresponding to a second data current from the data line in the capacitor of the second pixel circuit in response to the first scan signal applied through the second select signal line, while the second scan signal applied through the second emit signal line has the first level during a second field of the single frame; and (d) emitting light using the emission element of the second pixel circuit in response to a second current corresponding to the second voltage charged in the capacitor of the second pixel circuit transmitted from the transistor of the second pixel circuit in response to the second scan signal having the second level applied through the second emit signal line.

In a still another exemplary embodiment of the present invention, the method further includes: interrupting the current supplied to the emission element of the pixel circuit in response to the second scan signal having the first level, applied through the first emit signal line during the first field; and interrupting the current supplied to the emission element of the second pixel circuit in response to the second scan signal having the first level, applied through the second emit signal line during the second field.

In a further exemplary embodiment of the present invention, an emission display includes: a plurality of pixel circuits arranged as odd rows and even rows of the pixel circuits, each said pixel circuit for emitting light, and being coupled to a corresponding data line, a corresponding select signal line and a corresponding emit signal line; and a driver for providing a data current, a first scan signal and a second scan signal to each said pixel circuit through the corresponding data line, the corresponding select signal line and the corresponding emit signal line, respectively. Each pixel circuit is charged with the data current responsive to the first scan signal applied to the corresponding select signal line, and each said pixel circuit emits light responsive to the second scan signal having a first level, wherein the second scan signal is a pulse, which switches between the first level and a second level during a single frame.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

In the following detailed description, only certain exemplary embodiments of the present invention are shown and described, by way of illustration. As those skilled in the art would recognize, the described exemplary embodiments may be modified in various different ways, all without departing from the spirit or scope of the present invention. Accordingly, the drawings and description are to be regarded as illustrative in nature, and not restrictive.

An emission display, a pixel circuit, and a driving method according to exemplary embodiments of the present invention will be described with reference to drawings. The emission display described hereinafter is an organic EL display having organic emission cells. However, the present invention is not restricted to just the organic EL display having organic emission cells.

Figure 1:
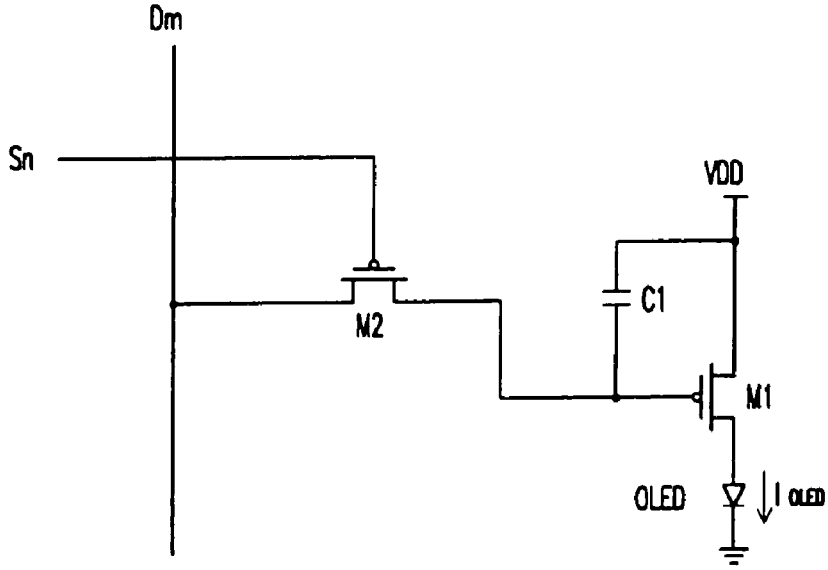
FIG.1 PRIOR ART
FIG. 1 is an equivalent circuit diagram for a pixel circuit which implements the conventional voltage programming method.
Figure 2:
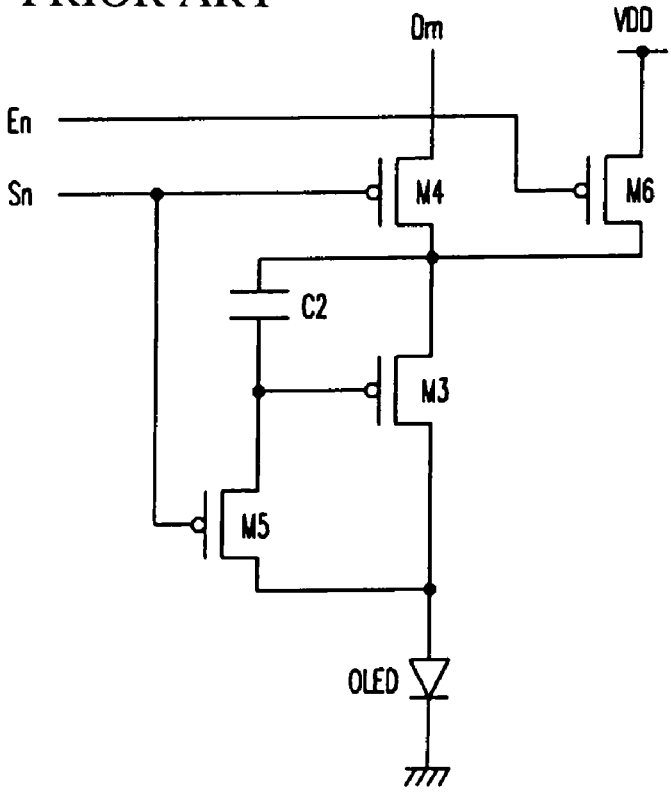
FIG.2 PRIOR ART
FIG. 2 is an equivalent circuit diagram for a pixel circuit which implements the conventional current programming method.
Figure 3:
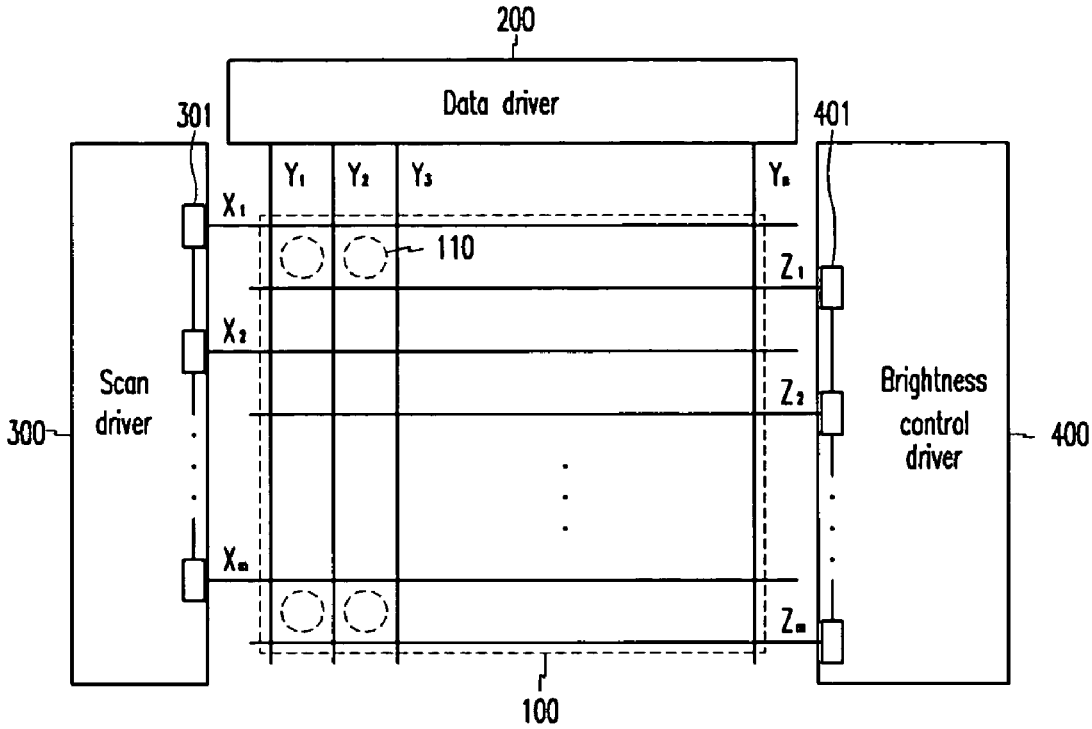
FIG. 3 is a block diagram of an emission display according to a first exemplary embodiment of the present invention.

FIG. 3 is a block diagram of an emission display according to a first exemplary embodiment of the present invention.

As shown, the emission display includes an organic EL display panel 100 (referred to as a display panel hereinafter), a data driver 200, a scan driver 300, and a brightness control driver 400.

The display panel 100 includes a plurality of data lines $Y_1$ through $Y_n$ arranged in the row direction, a plurality of signal lines $X_1$ through $X_m$ and $Z_1$ through $Z_m$ arranged in the column direction, and a plurality of pixel circuits 110.

The signal lines include a plurality of select signal lines $X_1$ through $X_m$ for transmitting a first scan signal, and a plurality of emit signal lines $Z_1$ through $Z_m$ for transmitting a second scan signal for controlling an emission period of an OLED. Pixel circuits 110 are formed at pixel regions defined by the data lines $Y_1$ through $Y_n$, and the select and emit signal lines $X_1$ through $X_m$ and $Z_1$ through $Z_m$. The scan driver 300 includes a shift register 301 for sequentially applying the first scan signals on the select signal lines. Similarly, the brightness control driver 400 includes a shift register 401 for sequentially applying the second scan signals on the emit signal lines. The scan driver and the brightness control driver may include other circuitry for sequential application of the signals in other embodiments.

The data driver 200 applies the data current $I_{DATA}$ to the data lines $Y_1$ through $Y_n$. The scan driver 300 sequentially applies the first scan signal for selecting pixel circuits to the select signal lines $X_1$ through $X_m$. The brightness control driver 400 sequentially applies the second scan signal for controlling the brightness of the pixel circuit 110 to the emit signal lines $Z_1$ through $Z_m$.

The scan driver 300 and the brightness control driver 400 and/or the data driver 200 are coupled to the display panel 100, or are installed in a chip configuration on a tape carrier package (TCP) adhered and coupled to the display panel 100. They may also be installed in a chip configuration on a flexible printed circuit (FPC) or a film adhered and coupled to the display panel 100, which is referred to as a chip on flexible board or chip on film (COF) method. The scan driver 300 and the brightness control driver 400 and/or the data driver 200 may also be installed on a glass substrate, which is referred to as a chip on glass (COG) method. They can be substituted for a driving circuit having a layer identical with that of the signal lines, data lines, and TFTs on the glass substrate.

Figure 4:
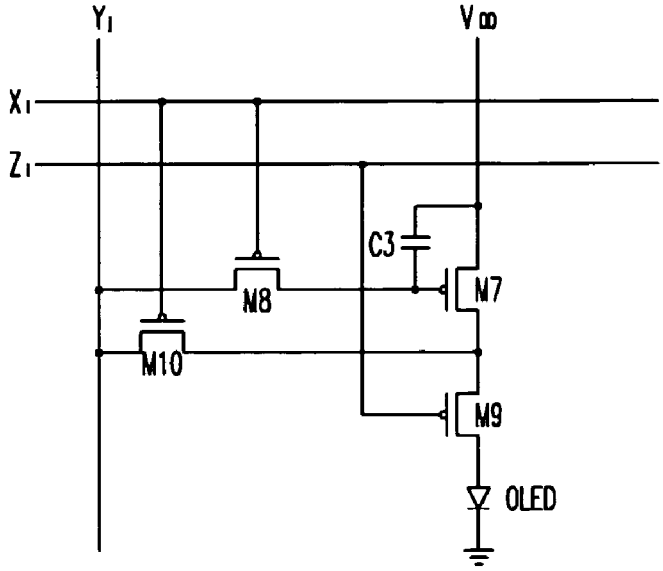
FIG. 4 is a pixel circuit of the emission display of FIG. 3.
Figure 5A:
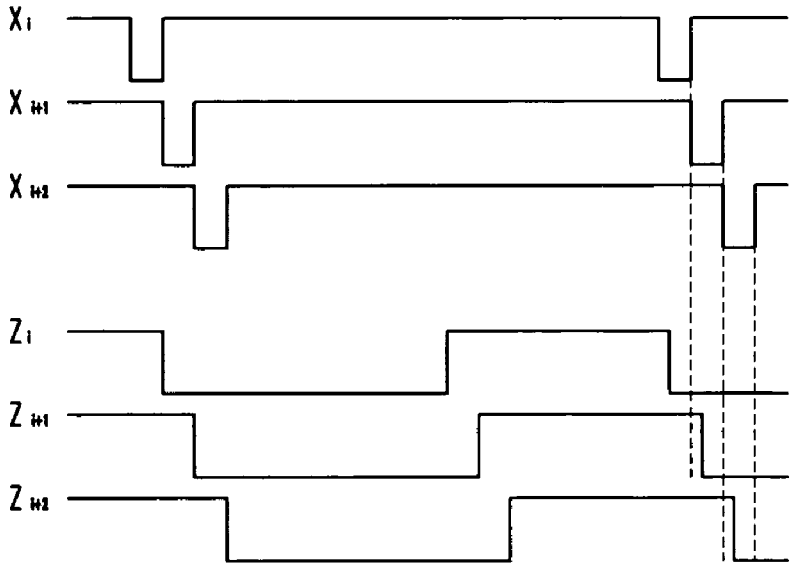
FIG. 5A is a timing diagram of first and second scan signals respectively applied to first and second select signal lines according to the first exemplary embodiment of the present invention.
Figure 5B:
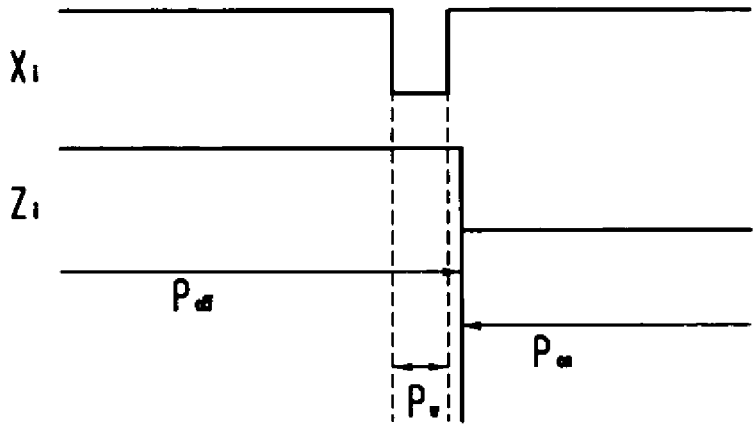
FIG. 5B is a comparison diagram of the first and second scan signals.

Referring now to FIGS. 4, 5A, and 5B, the pixel circuit 110 of the emission display according to the first exemplary embodiment of the present invention will be described. FIG. 4 is an equivalent circuit of the pixel circuit according to the first exemplary embodiment, and FIGS. 5A and 5B are timing diagrams of first and second scan signals for driving the pixel circuit of FIG. 4. For ease of description, FIG. 4 shows a pixel circuit coupled to the $j^{th}$ data line $Y_j$ and the $i^{th}$ signal lines $X_i$ and $Z_i$. Other pixel circuits 110 of the display panel 100 each have substantially the same configuration as the pixel circuit of FIG. 4.

As shown in FIG. 4, the pixel circuit 110 includes an OLED, transistors M7 through M10, and a capacitor C3. PMOS transistors are used for the transistors M7 through M10, but the transistor types are not restricted to the PMOS transistors. Each transistor should be a TFT that has a gate electrode, a drain electrode, and a source electrode formed on the glass substrate of the display panel 100, respectively, as a control electrode and two main electrodes. However, the transistors may instead be formed on other substrates and/or chips.

In detail, three electrodes of the transistor M8 are respectively coupled to a select signal line $X_i$, a data line $Y_j$, and a capacitor C3. The data current $I_{DATA}$ from the data line $Y_j$ is transmitted to the gate of the transistor M7 in response to the first scan signal from the select signal $X_i$. The data current is transmitted to the gate of the transistor M7 until a current corresponding to the data current $I_{DATA}$ flows to the drain of the transistor M7. The capacitor C3 is coupled between the gate and the source of the transistor M7, and charges the voltage corresponding to the data current $I_{DATA}$ from the data line $Y_j$. The current given in Equation 2 flows to the transistor M7 according to the voltage charged at the capacitor C3.

The transistor M9 is provided between the transistor M7 and the OLED, and couples the transistor M7 with the OLED in response to a low-level second scan signal from the emission signal line $Z_i$. The OLED is coupled between the transistor M9 and the ground voltage, and emits light in response to the current supplied through the transistor M9. The transistor M10 transmits the applied data current $I_{DATA}$ to the drain of the transistor M7 in response to a low-level first scan signal from the select signal line $X_i$.

Further, other types of pixel circuits using a current mirror can be used for the pixel circuit in other exemplary embodiments Referring to FIGS. 5A and 5B, an operation of the emission display according to the first exemplary embodiment of the present invention will be described in detail.

FIG. 5A is a timing diagram of first and second scan signals respectively applied to a select signal line and an emit signal line according to the first exemplary embodiment of the present invention, and FIG. 5B is a comparison diagram of the first and second scan signals.

As shown in FIG. 5A, the first scan signals for turning on the transistor M8 are sequentially applied to the select signal lines $X_i$, $X_{i+1}$, and $X_{i+2}$. When the transistor M8 is turned on, a voltage corresponding to the data current $I_{DATA}$ from the data lines $Y_1$ through $Y_n$ is charged in the capacitor C3. In this instance, the transistor M10 is also turned on because of the first scan signal, and the transistor M7 is diode-connected, and accordingly, the capacitor C3 is charged with the voltage corresponding to the data current $I_{DATA}$ flowing through the transistor M7. When the charging is finished, the transistors M8 and M10 are turned off, the transistor M9 is turned on according to the second scan signal applied from the emit signal lines $Z_i$, $Z_{i+1}$, and $Z_{i+2}$, and the data current $I_{DATA}$ flows through the transistor M9.

In the above-described operation of the emission display, levels of the second scan signals applied to the emit signal lines $Z_i$, $Z_{i+1}$, and $Z_{i+2}$ are sequentially changed as shown in FIG. 5A. When the second scan signals applied to the emit signal lines $Z_i$, $Z_{i+1}$, and $Z_{i+2}$ are low-level, the transistor M9 is turned on, the current applied from the transistor M7 is supplied to the OLED, and the OLED emits light in response to the current (during an emission period (Pon)). When the second scan signals applied to the emit signal lines $Z_i$, $Z_{i+1}$, and $Z_{i+2}$ are high-level, the transistor M9 is turned off, the current applied from the transistor M7 is not supplied to the OLED, and hence, the OLED emits no light (during a non-emission period (Poff)).

In detail, as shown in FIG. 5B, the first scan signal for turning on the transistor M7 is applied during the non-emission period Poff to charge the voltage corresponding to the data current $I_{DATA}$ from the data lines $Y_1$ through $Y_n$ in the capacitor C3 (during a writing period (Pw)). When the writing period is finished, and a predetermined time elapses, the level of the second scan signal applied to the emit signal line $Z_i$ becomes low-level to start the emission period (Pon). When the emission is executed for a predetermined time, the level of the second scan signal becomes high-level, no current is applied to the OLED, and the non-emission period Poff starts during which the OLED emits no light.

In the first exemplary embodiment, lengths of the emission period Pon and the non-emission period Poff are controlled according to a duty ratio of the second scan signal supplied from the brightness control driver 400, and the brightness is accordingly controlled. Total brightness of the pixels is not increased, and the power consumption is not greatly increased because of duty driving when a high data current is used.

Also, by using a high current area, a current characteristic variation of the transistor is reduced, and a stable operation of the emission display is provided.

Since the OLED is very sensitive to voltage variation, driving the OLED with frequencies of less than 30 Hz generates flickers. In particular, the flickers may be generated in the first exemplary embodiment since the OLED is sequentially driven per horizontal line, and the emission period and the non-emission period are alternately generated within a single line.

Therefore, in order to eliminate or reduce the flickers generated by the duty driving, a subsequent emission display is driven in the second exemplary embodiment.

Figure 6:
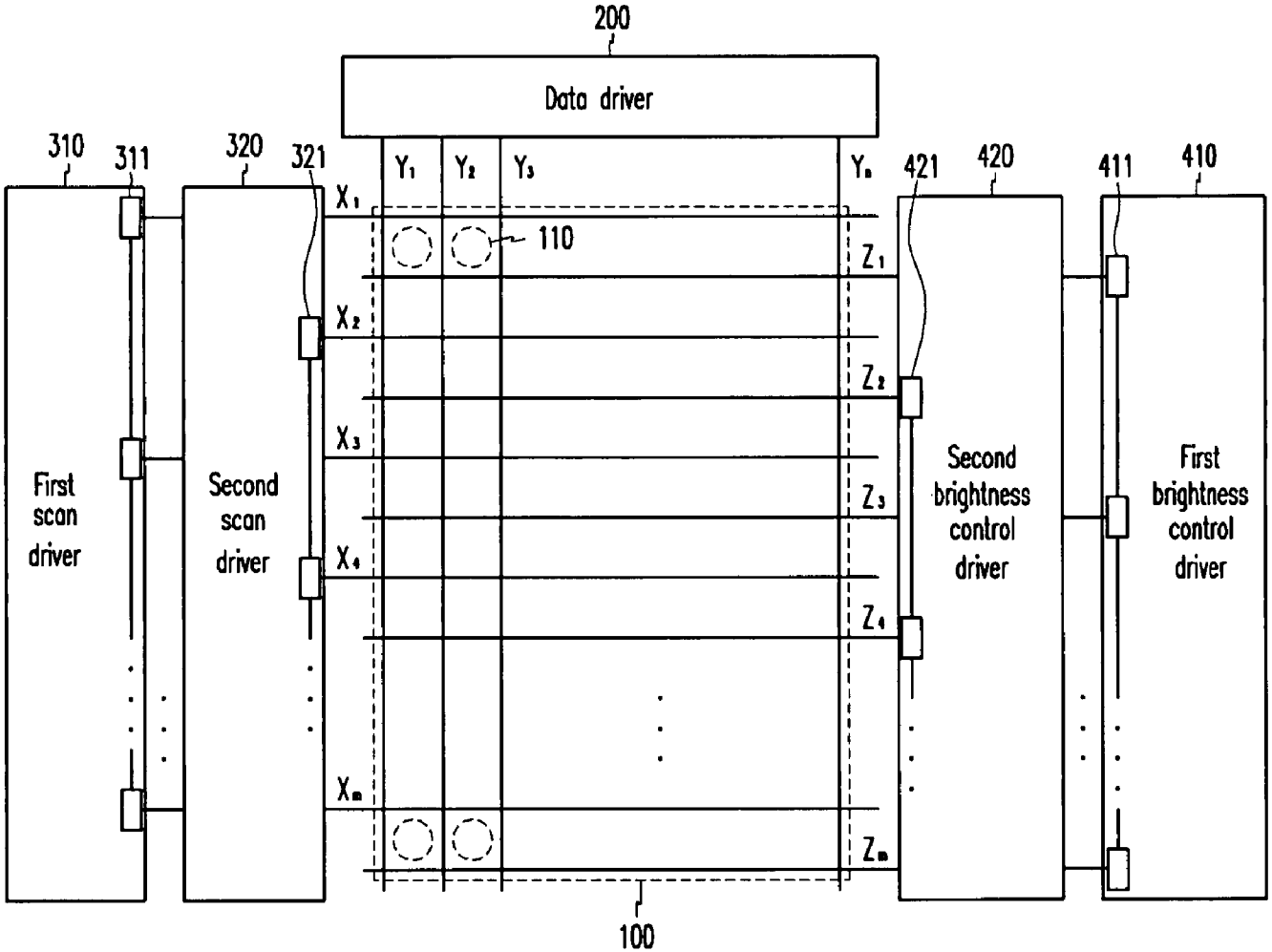
FIG. 6 is a block diagram of an emission display according to a second exemplary embodiment of the present invention.

FIG. 6 is an emission display according to a second exemplary embodiment of the present invention. Components that are identical to those of the first exemplary embodiment have the same reference numerals, and their descriptions are omitted.

As shown in FIG. 6, the emission display according to the second exemplary embodiment Includes a display panel 100, a data driver 200, a scan driver, and a brightness control driver. The scan driver includes a first scan driver 310 and a second scan driver 320, and the brightness control driver includes a first brightness control driver 410 and a second brightness control driver 420.

The first scan driver 310 sequentially applies first scan signals for selecting a pixel circuit to odd select signal lines ($X_1$, $X_3$, . . . ) during an odd field of a single frame, and the second scan driver 320 sequentially applies first scan signals for selecting a pixel circuit to even select signal lines ($X_2$, $X_4$, . . . ) during an even field of a single frame. For sequential application of the first scan signals, the first and second scan drivers 310 and 320 include, respectively, the shift registers 311 and 321. The first and second scan drivers may include other circuitry in other embodiments for sequential application of the first scan signals.

The first brightness control driver 410 sequentially applies second scan signals for controlling the brightness of the pixel circuit 110 to the odd emit signal lines ($Z_1$, $Z_3$, . . . ) during an odd field of a single frame, and the second brightness control driver 420 sequentially applies second scan signals for selecting pixels to the even emit signal lines ($Z_2$, $Z_4$, . . . ) during an even field of a single frame. For sequential application of the second scan signals, the first and second brightness control drivers 410 and 420 include, respectively, the shift registers 411 and 421. The first and second brightness control drivers may include other circuitry in other embodiments for sequential application of the second scan signals. Since the configurations of the display panel 100 and the data driver 200 correspond to those of the first exemplary embodiment, no further corresponding description will be provided.

A driving of the emission display according to the second exemplary embodiment will be described with reference to FIG. 7.

Figure 7:
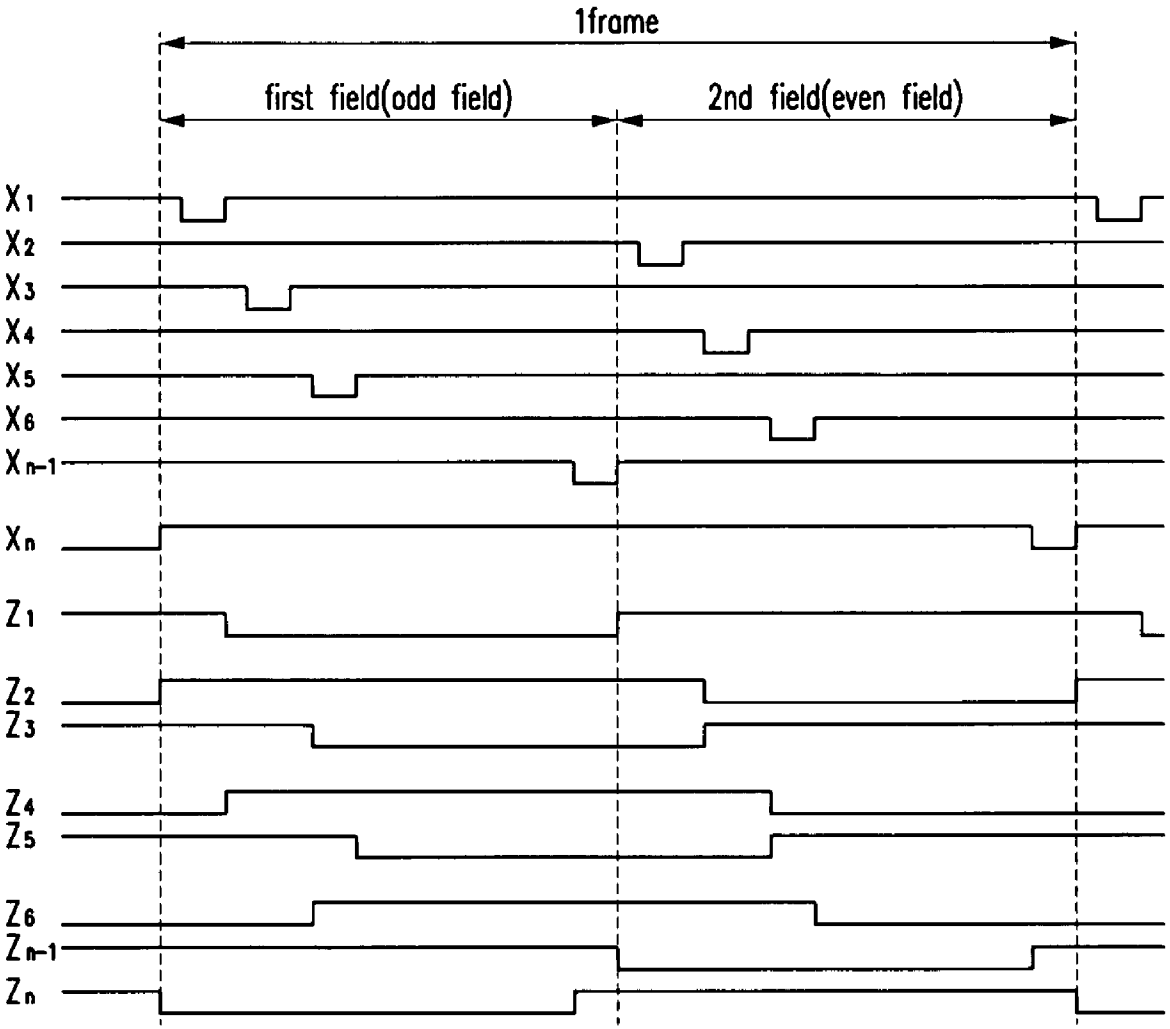
FIG. 7 is a timing diagram of first and second scan signals respectively applied to first and second select signal lines according to the second exemplary embodiment of the present invention.

FIG. 7 is a timing diagram of first and second scan signals for driving the pixel circuit of the emission display according to the second exemplary embodiment of the present invention.

Off times (i.e., non-emission times of the OLED) between adjacent lines are made different from one another to prevent detecting on/off states of images or weakly detecting the on/off states of images. In other words, the display is interlaced to prevent or to reduce flickering of images.

To achieve this, an interlace scan driving method for dividing a single frame into an add field and an even field, sequentially driving odd signal lines during the odd field, and sequentially driving even signal lines during the even field, is performed without sequentially driving the signal lines during the single frame.

In further detail, as shown in FIG. 7, the first scan driver 310 applies first scan signals for turning on the transistor M8 to the odd select signal lines ($X_1$, $X_3$, $X_5$, . . . ) during the odd field of the first frame. Synchronized with the first scan signals, the first brightness control driver 410 sequentially applies second scan signals for turning on the transistor M9 to the odd emit signal lines ($Z_1$, $Z_3$, $Z_5$, . . . ).

Accordingly, the transistors M8 and M10 are turned on in the same manner as in the first exemplary embodiment, a voltage corresponding to the data current $I_{DATA}$ is charged in the capacitor C3, and the data current $I_{DATA}$ flows through the transistor M9.

After this, when the levels of the second scan signals applied to the odd emit signal lines ($Z_1$, $Z_3$, $Z_5$, . . . ) are sequentially changed, the emission is performed. That is, the second scan signals are output as high-level, and the current applied from the transistor M7 is not supplied to the OLED during the writing period Pw in which the first scan signals are output as low-level and a voltage corresponding to the data current $I_{DATA}$ is charged in the capacitor C3. Hence, the OLED emits no light. When the first scan signals are output as high-level, the transistors M8 and M10 are turned off, the second scan signals are output as low-level after a predetermined time to start an emission period, and the transistor M9 is accordingly turned on, and the data current $I_{DATA}$ applied from the transistor M7 is supplied to the OLED, and the OLED emits light in response.

As described, the pixel circuits coupled to the odd select signal lines ($X_1$, $X_3$, $X_5$, . . . ) and the odd emit signal lines ($Z_1$, $Z_3$, $Z_5$, . . . ) are duty-driven according to the first and second scan signals respectively applied to the odd select signal lines and the odd emit signal lines during the odd field.

When the odd field terminates and an even field starts, the first scan driver 310 and the first brightness control driver 410 are intercepted, and the second scan driver 320 sequentially applies first scan signals for turning on the transistor M8 to the even select signal lines ($X_2$, $X_4$, $X_6$, . . . ) during the even field of the first frame. Synchronized with the first scan signals, the second brightness control driver 420 sequentially applies second scan signals for turning on the transistor M9 to the even emit signal lines ($Z_2$, $Z_4$, $Z_6$, . . . ).

Accordingly, while the first scan signals are output as low-level, and the second scan signals are output as high-level, a voltage corresponding to the data current $I_{DATA}$ is charged in the capacitor C3, and when the first scan signals are output as high-level, and the second scan signals are output as low-level, the data current $I_{DATA}$ is supplied to the OLED, and the OLED emits light.

As a result, the pixel circuits coupled to the even select signal lines ($X_2$, $X_4$, $X_6$, . . . ) and the even emit signal lines ($Z_2$, $Z_4$, $Z_6$, . . . ) are duty-driven (emit light or perform a display operation) according to the first and second scan signals respectively applied to the even select signal lines and the even emit signal lines during the even field.

In the above-described second exemplary embodiment, since the respective signal lines are not sequentially driven during one frame, the odd signal lines and the even signal lines are separately driven during the odd field and the even field, and the pixel circuits coupled to the respective signal lines are duty-driven, the emission period and the non-emission period between adjacent lines are made different from one another to thus remove or reduce the flickers.

While the present invention has been described in connection with certain exemplary embodiments, it is to be understood that the present invention is not limited to the disclosed embodiments, but, on the contrary, covers various modifications and equivalent arrangements included within the spirit and scope of the appended claims.

For example, while two scan drivers and two brightness control drivers are used, respectively, to drive part of the select signal lines and the emit signal lines during the odd field and the even field in the above-described exemplary embodiments, in other embodiments, different scan signal signals and brightness control signals for driving select signal lines and emit signal lines during the odd field and the even field may be generated using one scan driver and one brightness control driver. Also, the present invention is not restricted to the pixel circuit based on the current programming method, and may also be applied to the pixel circuit based on the voltage programming method.

When the duty driving and the interlaced scan driving are performed on the pixel circuit based on the voltage programming method as described above, pixel uniformity can be improved by use of a high current area with less variation of the current characteristics.

Also, while odd signal lines are driven during the odd field, and even signal lines are driven during the even field in the above exemplary described embodiments, in other embodiments, even signal lines may be driven during the odd field, and odd signal lines may be driven during the even field.

Further, the on/off time ratio of an emission element at the time of duty driving can be set to be 1:1, and the on/off time can be controlled with other ratios.

According to the present invention, the time for charging the data lines is effectively reduced. In particular, the time for charging the data lines is reduced without increasing the total brightness when the current $I_{OLED}$ flowing to the OLED is increased.

Also, the emission display is stably driven by using a high current domain having a small current characteristic variation of a driving transistor.

Further, the flickers are eliminated or reduced to improve image quality of the emission display.

What is claimed is:

1. An emission display comprising:

a plurality of data lines extending in one direction, each said data line for transmitting a data current;

a plurality of select signal lines crossing the data lines, each said select signal line for transmitting a first scan signal having an on level;

a plurality of emit signal lines crossing the data lines, each said emit signal line for transmitting a second scan signal;

a display panel including:

a first switch on a pixel area defined by a corresponding said data line, a corresponding said select signal line, and a corresponding said emit signal line, for transmitting the data current from the corresponding said data line in response to the first scan signal from the corresponding said select signal line, a pixel circuit including a capacitor for charging a voltage corresponding to the data current from the first switch, an emission element, a transistor for supplying a current corresponding to the voltage charged in the capacitor to the emission element, and a second switch between the transistor and the emission element for supplying the current from the transistor to the emission element in response to a first level of the second scan signal from the corresponding said emit signal line; and a driver for supplying the first scan signal to the corresponding said select signal line, and supplying the second scan signal to the corresponding said emit signal line, wherein the select signal lines include first select signal lines and second select signal lines, wherein the corresponding said select signal line is one of the first select signal lines, wherein the driver is adapted to transmit the first scan signal having the on level to the corresponding said select signal line during a first field of a single frame, and to transmit the first scan signal having the on level to one of the second select signal lines during a second field of the single frame, and the driver is configured to transfer the second scan signal having a second level to the second switch to prevent the emission element from emitting during a non-emission period while the capacitor is being charged.

2. The emission display of claim 1, wherein the emit signal lines include first emit signal lines and second emit signal lines, wherein the corresponding said emit signal line is one of the first emit signal lines, and wherein the driver transmits the second scan signal to the corresponding said emit signal line in the first field of the single frame, and transmits the second scan signal to one of the second emit signal lines in the second field of the single frame.

3. The emission display of claim 2, wherein the driver comprises:

a first scan driver for supplying the first scan signal to each of the first select signal lines during the first field;

a first brightness control driver for supplying the second scan signal to each of the first emit signal lines during the first field;

a second scan driver for supplying the first scan signal to each of the second select signal lines during the second field; and a second brightness control driver for supplying the second scan signal to each of the second emit signal lines during the second field.

4. The emission display of claim 3, wherein at least one of the drivers includes a shift register.

5. The emission display of claim 1, wherein the second scan signal is a pulse, which is switched between the first level and a second level, wherein the emission element emits light responsive to the current from the second switch when the second scan signal has the first level, and wherein the current supplied to the emission element is interrupted when the second scan signal has the second level.

6. The emission display of claim 5, wherein the second scan signal is a pulse, which is switched between the first level and the second level in a single field.

7. The emission display of claim 1, wherein the display panel further comprises a third switch for charging the voltage corresponding to the data current from the corresponding said data line in the capacitor in response to the first scan signal.

8. The emission display of claim 1, wherein the capacitor charges the voltage corresponding to the data current when the second scan signal has a second level.

9. The emission display of claim 2, wherein the first select signal lines are odd select signal lines, and the first emit signal lines are odd emit signal lines, and wherein the second select signal lines are even select signal lines, and the second emit signal lines are even emit signal lines.

10. The emission display of claim 2, wherein the first select signal lines are even select signal lines, and the first emit signal lines are even emit signal lines, and wherein the second select signal lines are odd select signal lines, and the second emit signal lines are odd emit signal lines.

11. The emission display of claim 2, wherein at least one said second select signal line is provided between two adjacent said first select signal lines, and at least one said second emit signal line is provided between two adjacent said first emit signal lines.

12. The emission display of claim 1, wherein the driver is adapted to supply the second scan signal having the first level to the corresponding said emit signal line during a time period in the single frame following a time delay after the first scan signal transmitted to the corresponding said select signal line switches from the on level to an off level.

13. A display panel comprising:

a plurality of data lines extending in one direction, each said data line for transmitting a data current;

a plurality of select signal lines crossing the data lines, each said select signal line for transmitting a first scan signal having an on level;

a plurality of emit signal lines crossing the data lines, each said emit signal line for transmitting a second scan signal; a pixel circuit including:

a first switch on a pixel area defined by a corresponding said data line, a corresponding said select signal line, and a corresponding said emit signal line, for transmitting the data current from the corresponding said data line in response to the first scan signal from the corresponding said select signal line;

a capacitor for charging a voltage corresponding to the data current from the first switch; an emission element;

a transistor for supplying a current corresponding to the voltage charged in the capacitor to the emission element; and a second switch between the transistor and the emission element for supplying the current from the transistor to the emission element in response to a first level of the second scan signal from the corresponding said emit signal line, wherein the select signal lines include first select signal lines and second select signal lines, and the emit signal lines include first emit signal lines and second emit signal lines, wherein the first scan signal and the second scan signal are transmitted to the first select signal line and the first emit signal line, respectively, during an odd field of a single frame and the first scan signal and the second scan signal are transmitted to the second select signal line and the second emit signal line, respectively, during an even field of the single frame, wherein the second scan signal has the first level during a time period in a single frame, wherein the second scan signal is a pulse, which is switched between the first level and a second level, and wherein the emission element emits light responsive to the current from the second switch when the second scan signal has the first level, and the current supplied to the emission element is interrupted when the second scan signal has the second level.

14. The display panel of claim 13, wherein the second scan signal is a pulse, which is switched between the first level and a second level, and wherein the emission element emits light responsive to the current from the second switch when the second scan signal has the first level, and the current supplied to the emission element is interrupted when the second scan signal has the second level.

15. The display panel of claim 13, wherein the pixel circuit further comprises a third switch for charging the voltage corresponding to the data current from the corresponding said data line in the capacitor in response to the first scan signal.

16. The display panel of claim 13, wherein the second scan signal switches to the first level following a time delay after a corresponding one of the first scan signals switches from the on level to an off level.

17. A method for driving an emission display comprising a data line, a first select signal line, a second select signal line, a first emit signal line, a second emit signal line, a pixel circuit at a pixel area defined by the data line, the first select signal line, and the first emit signal line, and a second pixel circuit at a second pixel area defined by the data line, the second select signal line and the second emit signal line, wherein the select signal lines and the emit signal lines cross the data line, the pixel circuit and the second pixel circuit each including a capacitor, a transistor for supplying a current corresponding to a voltage charged in the capacitor, an emission element, the method comprising:

(a) charging the voltage corresponding to a data current from the data line in the capacitor of the pixel circuit in response to a first scan signal having an on level applied through the first select signal line, while a second scan signal applied through the first emit signal line has a first level during a first field of a single frame;

(b) emitting light using the emission element of the pixel circuit in response to the current corresponding to the voltage charged in the capacitor of the pixel circuit transmitted from the transistor of the pixel circuit in response to the second scan signal having a second level, applied through the first emit signal line following a time delay after the first scan signal applied through the first select signal line switches from the on level to an off level;

(c) charging a second voltage corresponding to a second data current from the data line in the capacitor of the second pixel circuit in response to the first scan signal having the on level applied through the second select signal line, while the second scan signal applied through the second emit signal line has the first level during a second field of the single frame; and (d) emitting light using the emission element of the second pixel circuit in response to a second current corresponding to the second voltage charged in the capacitor of the second pixel circuit transmitted from the transistor of the second pixel circuit in response to the second scan signal having the second level applied through the second emit signal line following a time delay after the first scan signal applied through the second select signal line switches from the on level to the off level.

18. The method of claim 17, further comprising:

interrupting the current supplied to the emission element of the pixel circuit in response to the second scan signal having the first level, applied through the first emit signal line during the first field; and interrupting the current supplied to the emission element of the second pixel circuit in response to the second scan signal having the first level, applied through the second emit signal line during the second field.

* * * * *